US009874185B2

(12) United States Patent
Pursifull et al.

(10) Patent No.: US 9,874,185 B2
(45) Date of Patent: Jan. 23, 2018

(54) DIRECT INJECTION PUMP CONTROL FOR LOW FUEL PUMPING VOLUMES

(71) Applicant: Ford Global Technologies, LLC, Dearborn, MI (US)

(72) Inventors: Ross Dykstra Pursifull, Dearborn, MI (US); Mark Meinhart, South Lyon, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 193 days.

(21) Appl. No.: 14/284,220

(22) Filed: May 21, 2014

(65) Prior Publication Data

US 2015/0337783 A1 Nov. 26, 2015

(51) Int. Cl.
*F02B 3/00* (2006.01)
*F02M 59/20* (2006.01)
(Continued)

(52) U.S. Cl.
CPC ..... *F02M 59/20* (2013.01); *F02D 41/3845* (2013.01); *F02M 59/366* (2013.01);
(Continued)

(58) Field of Classification Search
CPC .... F02D 41/3845; F02D 41/009; F02D 41/20; F02D 1/00; F02D 1/183; F02D 2041/2027; F02D 2250/31; F02M 59/20; F02M 59/366; F02M 41/128; F02M 59/02; F02M 59/24; F02M 59/34; F02M 59/36; F02M 59/367; F02M 59/368; F02B 3/06
(Continued)

(56) References Cited

U.S. PATENT DOCUMENTS 5,230,613 A 7/1993 Hilsbos et al.
5,507,266 A 4/1996 Wright et al.
(Continued)

FOREIGN PATENT DOCUMENTS

CN 101231225 A 7/2008
EP 1355059 A2 10/2003
EP 2647824 A1 10/2013

OTHER PUBLICATIONS

Surnilla, Gopichandra et al., "Adaptive Learning of Duty Cycle for a High Pressure Fuel Pump," U.S. Appl. No. 14/099,615, filed Dec. 6, 2013, 44 pages.
(Continued)

*Primary Examiner* — Hai Huynh
*Assistant Examiner* — Gonzalo Laguarda
(74) *Attorney, Agent, or Firm* — Julia Voutyras; McCoy Russell LLP

(57) ABSTRACT

Methods are provided for controlling a solenoid spill valve of a direct injection fuel pump, wherein the solenoid spill valve is energized and de-energized according to certain conditions. A control strategy is needed to operate the direct injection fuel pump when small fractional trapping volumes are commanded, wherein a small amount of fuel is compressed and sent to the direct injection fuel rail. To maintain reliable and repeatable solenoid spill valve behavior for small fractional trapping volumes, methods are proposed that involve energizing the solenoid spill valve for a minimum angular duration below a trapping volume fraction threshold.

18 Claims, 6 Drawing Sheets

(51) Int. Cl.

| | |
|---|---|
| ***F02M 59/36*** | (2006.01) |
| ***F02D 41/38*** | (2006.01) |
| *F02D 41/00* | (2006.01) |
| *F02D 41/20* | (2006.01) |

(52) U.S. Cl.
CPC ..... *F02D 41/009* (2013.01); *F02D 41/20* (2013.01); *F02D 2041/2027* (2013.01); *F02D 2250/31* (2013.01)

(58) Field of Classification Search
USPC ..... 123/506, 496
See application file for complete search history.

(56) References Cited

U.S. PATENT DOCUMENTS

| | | | | |
|---|---|---|---|---|
| 5,598,817 | A | 2/1997 | Igarashi et al. | |
| 5,715,797 | A | 2/1998 | Minagawa et al. | |
| 5,755,211 | A | 5/1998 | Koch | |
| 5,884,597 | A | 3/1999 | Hiraku et al. | |
| 5,941,214 | A | 8/1999 | Hoffmann et al. | |
| 6,209,525 | B1 | 4/2001 | Konishi et al. | |
| 6,230,688 | B1 | 5/2001 | Faix et al. | |
| 6,378,489 | B1 | 4/2002 | Stanglmaier et al. | |
| 6,408,822 | B1 | 6/2002 | Rembold et al. | |
| 6,422,203 | B1 | 7/2002 | Djordjevic | |
| 6,439,202 | B1 | 8/2002 | Carroll, III et al. | |
| 6,609,500 | B2 | 8/2003 | Ricco et al. | |
| 6,694,950 | B2 | 2/2004 | Djordjevic | |
| 6,694,952 | B1 * | 2/2004 | Yamazaki | F02M 59/102 123/496 |
| 6,725,837 | B2 | 4/2004 | Hiraku et al. | |
| 6,739,317 | B2 | 5/2004 | Kellner et al. | |
| 6,742,479 | B2 | 6/2004 | Yanagisawa | |
| 6,748,923 | B2 | 6/2004 | Grossner et al. | |
| 6,871,633 | B1 | 3/2005 | Date et al. | |
| 6,953,025 | B2 | 10/2005 | Takahashi | |
| 6,988,492 | B2 | 1/2006 | Shetley | |
| 6,990,958 | B2 | 1/2006 | Asano et al. | |
| 7,007,662 | B2 | 3/2006 | Sakai et al. | |
| 7,013,872 | B2 | 3/2006 | Yamazaki et al. | |
| 7,258,103 | B2 | 8/2007 | Tahara et al. | |
| 7,347,186 | B2 | 3/2008 | Ricco et al. | |
| 7,350,510 | B2 | 4/2008 | Tomatsuri et al. | |
| 7,377,753 | B2 | 5/2008 | Kuroda | |
| 7,584,747 | B1 | 9/2009 | Ibrahim et al. | |
| 7,640,916 | B2 | 1/2010 | Ulrey et al. | |
| 7,770,562 | B2 | 8/2010 | Purisfull et al. | |
| 7,814,887 | B2 | 10/2010 | Cwielong et al. | |
| 7,950,371 | B2 | 5/2011 | Cinpinski et al. | |
| 8,220,322 | B2 | 6/2012 | Wang et al. | |
| 8,342,151 | B2 | 1/2013 | Gwidt et al. | |
| 8,590,510 | B2 | 11/2013 | Surnilla et al. | |
| 2003/0029423 | A1 | 2/2003 | Boehland et al. | |
| 2004/0154594 | A1 | 8/2004 | Miyashita | |
| 2005/0199219 | A1 | 9/2005 | Utsumi | |
| 2007/0079809 | A1 * | 4/2007 | Oono | F02D 41/3845 123/456 |
| 2008/0216797 | A1 | 9/2008 | Oono | |
| 2008/0257304 | A1 | 10/2008 | Noda et al. | |
| 2009/0090331 | A1 | 4/2009 | Pursifull | |
| 2009/0159057 | A1 | 6/2009 | Pursifull et al. | |
| 2010/0108035 | A1 | 5/2010 | Dusa et al. | |
| 2010/0268441 | A1 * | 10/2010 | Yoshiume | F02D 41/062 701/103 |
| 2011/0097228 | A1 | 4/2011 | Tokuo et al. | |
| 2011/0162724 | A1 | 7/2011 | Kleckler | |
| 2011/0208409 | A1 | 8/2011 | Snyder et al. | |
| 2012/0048242 | A1 | 3/2012 | Surnilla et al. | |
| 2012/0118271 | A1 * | 5/2012 | Borg | F02D 41/20 123/495 |
| 2012/0143475 | A1 | 6/2012 | Ryoo et al. | |
| 2012/0167859 | A1 | 7/2012 | Basmaji et al. | |
| 2013/0213359 | A1 | 8/2013 | Zeng et al. | |

OTHER PUBLICATIONS

Surnilla, Gopichandra et al., "Robust Direct Injection Fuel Pump System," U.S. Appl. No. 14/155,250, filed Jan. 14, 2014, 61 pages.
Zhang, Hao et al., "Methods for Correcting Spill Valve Timing Error of a High Pressure Pump," U.S. Appl. No. 14/189,926, filed Feb. 25, 2014, 51 pages.
Pursifull, Ross D. et al., "Methods for Determining Fuel Bulk Modulus in a High-Pressure Pump," U.S. Appl. No. 14/189,946, filed Feb. 25, 2014, 52 pages.
Pursifull, Ross D. et al., "Direct Injection Fuel Pump," U.S. Appl. No. 14/198,082, filed Mar. 5, 2014, 67 pages.
Pursifull, Ross D. et al., "Rapid Zero Flow Lubrication Methods for a High Pressure Pump," U.S. Appl. No. 14/231,451, filed Mar. 31, 2014, 54 pages.
Ulrey, Joseph N. et al., "Adjusting Pump Volume Commands for Direct Injection Fuel Pumps," U.S. Appl. No. 14/300,162, filed Jun. 9, 2014, 42 pages.

* cited by examiner

DIRECT INJECTION PUMP CONTROL FOR LOW FUEL PUMPING VOLUMES

FIELD

The present application relates generally to control schemes for a direct injection fuel pump when operating with low displacement volumes in an internal combustion engine.

SUMMARY/BACKGROUND

Some vehicle engine systems utilizing direct in-cylinder injection of fuel include a fuel delivery system that has multiple fuel pumps for providing suitable fuel pressure to fuel injectors. This type of fuel system, Gasoline Direct Injection (GDI), is used to increase the power efficiency and range over which the fuel can be delivered to the cylinder. GDI fuel injectors may require high pressure fuel for injection to create enhanced atomization for more efficient combustion. As one example, a GDI system can utilize an electrically driven lower pressure pump (i.e., a fuel lift pump) and a mechanically driven higher pressure pump (i.e., a direct injection pump) arranged respectively in series between the fuel tank and the fuel injectors along a fuel passage. In many GDI applications the high-pressure fuel pump may be used to increase the pressure of fuel delivered to the fuel injectors. The high-pressure fuel pump may include a solenoid actuated "spill valve" (SV) or fuel volume regulator (FVR) that may be actuated to control flow of fuel into the high-pressure fuel pump. Various control strategies exist for operating the higher and lower pressure pumps to ensure efficient fuel system and engine operation.

In one approach to control the direct injection fuel pump, shown by Hiraku et al. in U.S. Pat. No. 6,725,837, a controller performs a series of calculations to control a direct injection fuel pump and direct injectors of an engine. In the related fuel system, a solenoid valve is switched on and off to inhibit or allow fuel to enter the direct injection fuel pump, thereby varying the discharge rate of the pump. To achieve the target fuel ejection volume of the pump as controlled by the solenoid valve, a correction time width is calculated based on characteristics of pump and injector operation. In an example, the controller detects running status of the engine from a variety of parameters to determine injection start timing and a target injection time width. Furthermore, the controller calculates a discharge start timing and a discharge time width of the direct injection fuel pump based on the parameters. The parameters include the acceleration opening, crank angle, and engine speed. By checking overlap between the injection period and discharge period of the pump, values are determined that are used to find the correction time width of the injectors.

However, the inventors herein have identified potential issues with the approach of U.S. Pat. No. 6,725,837. First, while the method of Hiraku et al. may provide control of the direct injection fuel pump for the fuel discharge rate range 0% to 100% as described, Hiraku et al. does not address various problems that may arise with low fuel discharge rates, such as ranging from 0% to 15%. The inventors herein have recognized that control strategies are needed that specifically address unrepeatability and unreliability that may be associated with turning the solenoid valve on and off quickly when small pumping volumes or discharge rates are desired.

Thus in one example, the above issues may be at least partially addressed by a method, comprising: during a first condition, energizing a solenoid spill valve of a direct injection fuel pump for only an angular duration based on a position of a piston of the direct injection fuel pump; and during a second condition, energizing the solenoid spill valve for or longer than a minimum angular duration, wherein the solenoid spill valve is deactivated after a top-dead-center position of the piston is reached. For example, the first condition includes when a trapping volume fraction of the direct injection fuel pump is above a threshold and the second condition includes when the trapping volume fraction is below a threshold. The trapping volume fraction, or displacement or pumped volume, is a measure of how much fuel is compressed and ejected to a fuel rail by the direct injection fuel pump. In this way, the direct injection pump is operated to ensure repeatability and reliability of the solenoid valve even for small trapping volumes.

In another example, the solenoid spill valve is turned on or energized when the fuel trapping volume is below a threshold, wherein the solenoid spill valve is energized for or longer than an angular duration independent of a position of a piston of the direct injection fuel pump. In some fuel systems, a sensor may measure angular position of a driving cam providing power to the pump piston so a controller can synchronize activation of the solenoid spill valve with the position of the driving cam and pump piston. In the disclosed method, control of the solenoid spill valve is applied in synchronism with the position of the pump piston during certain engine and fuel system operating conditions.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
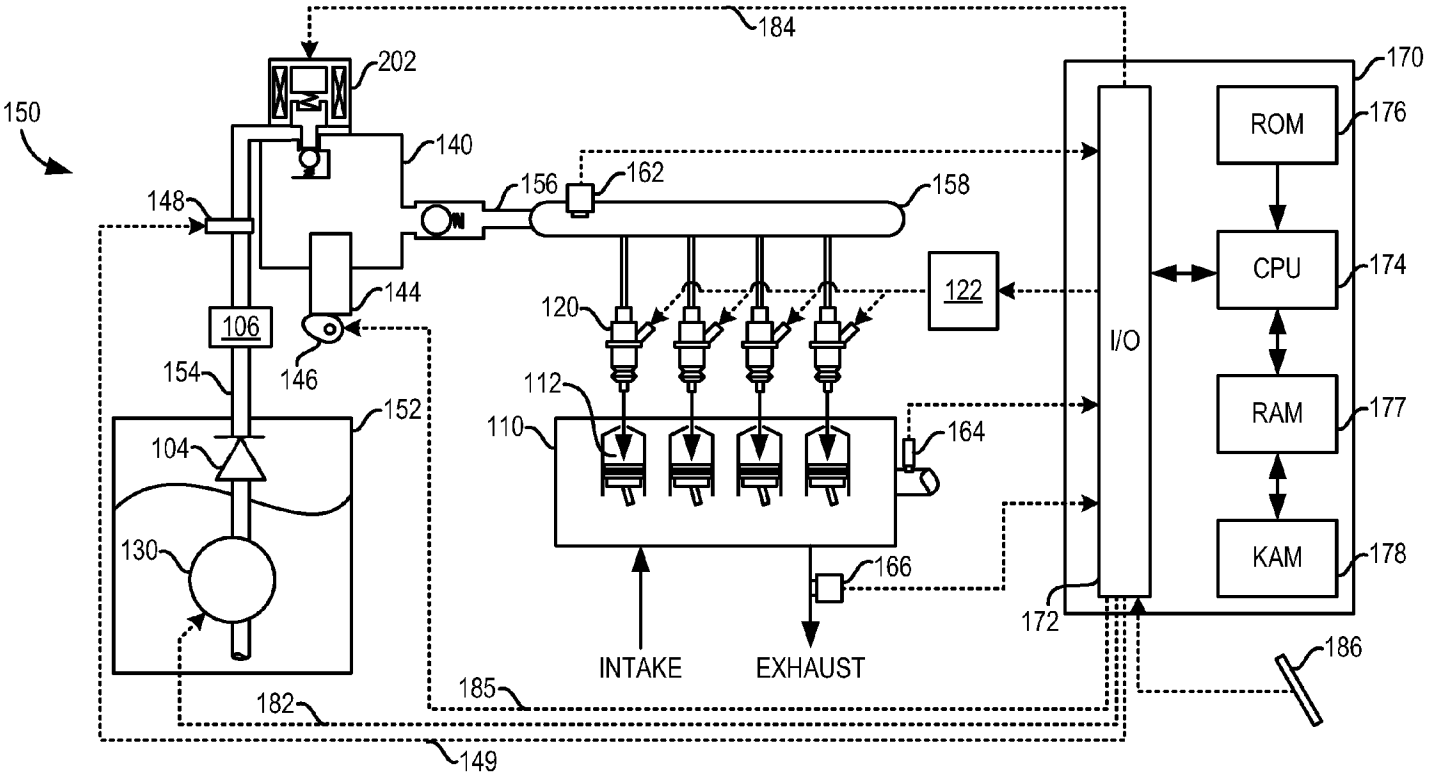
FIG. 1 shows a schematic diagram of an example fuel system coupled to an engine.
Figure 2:
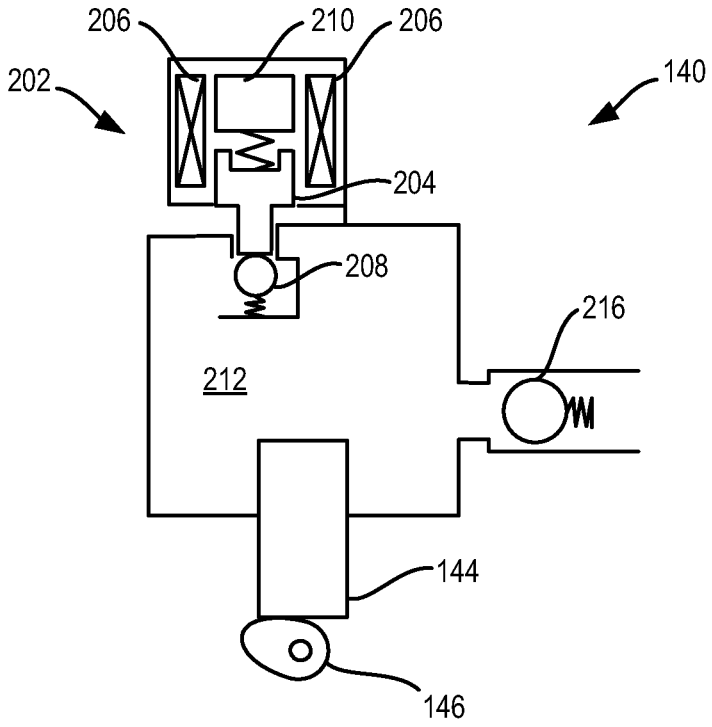
FIG. 2 shows a schematic diagram of a solenoid valve coupled to a direct injection fuel pump of the fuel system of FIG. 1.
Figure 3:
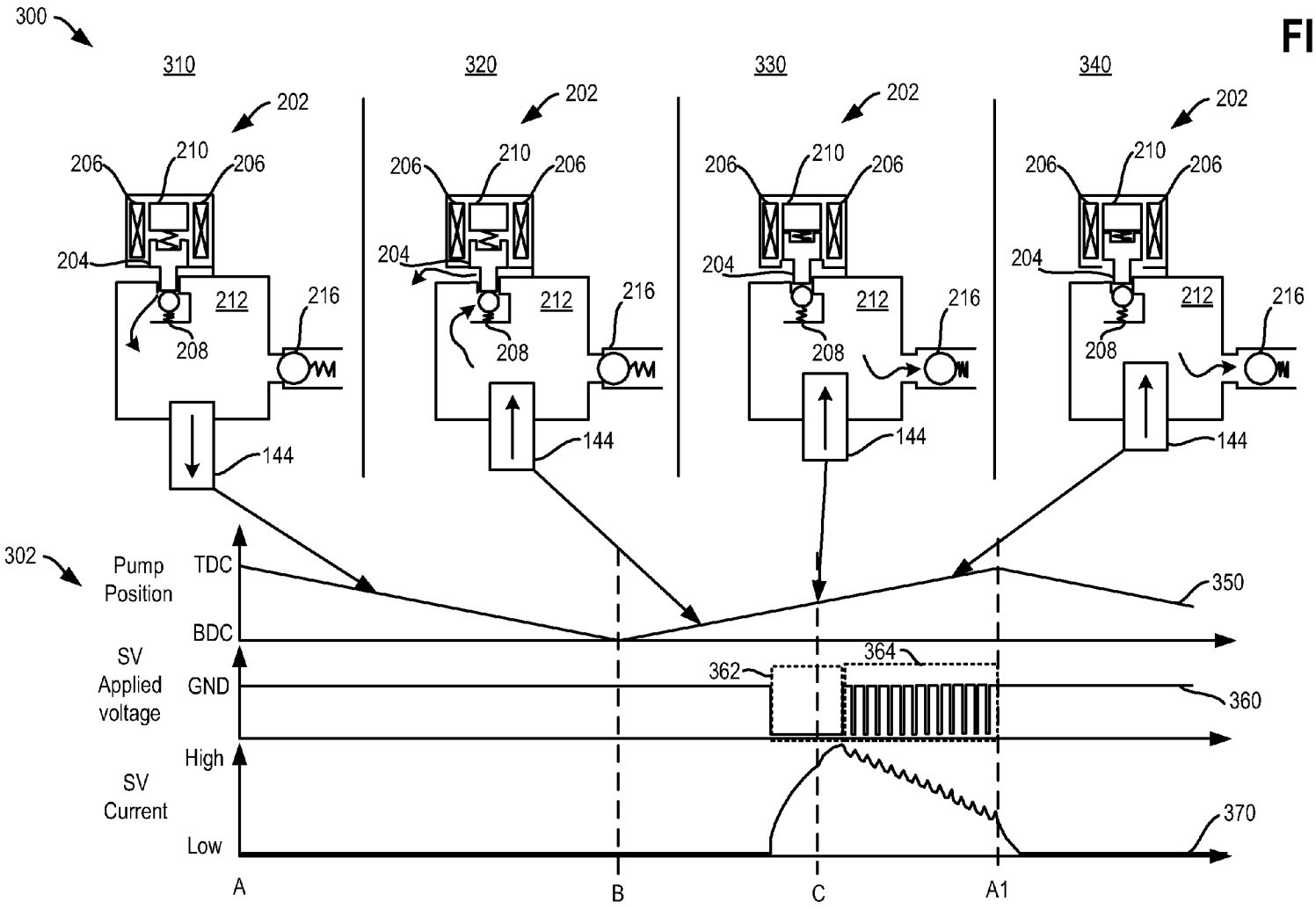
FIG. 3 shows an example hold-to-delivery control strategy of a direct injection fuel pump of the fuel system of FIG. 1.
Figure 4:
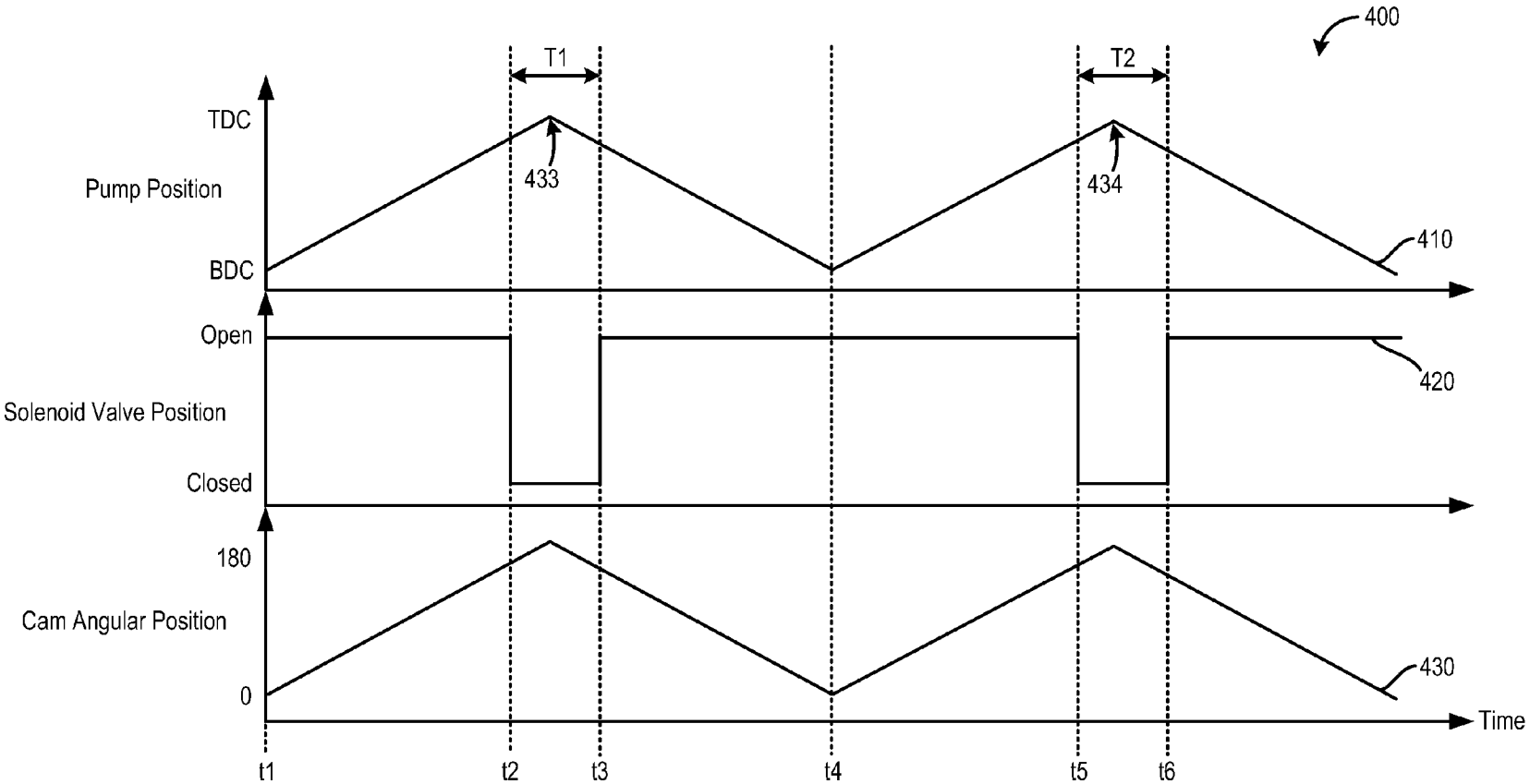
FIG. 4 graphically shows an example minimum energize angle control strategy of a direct injection fuel pump of the fuel system of FIG. 1.
Figure 5:
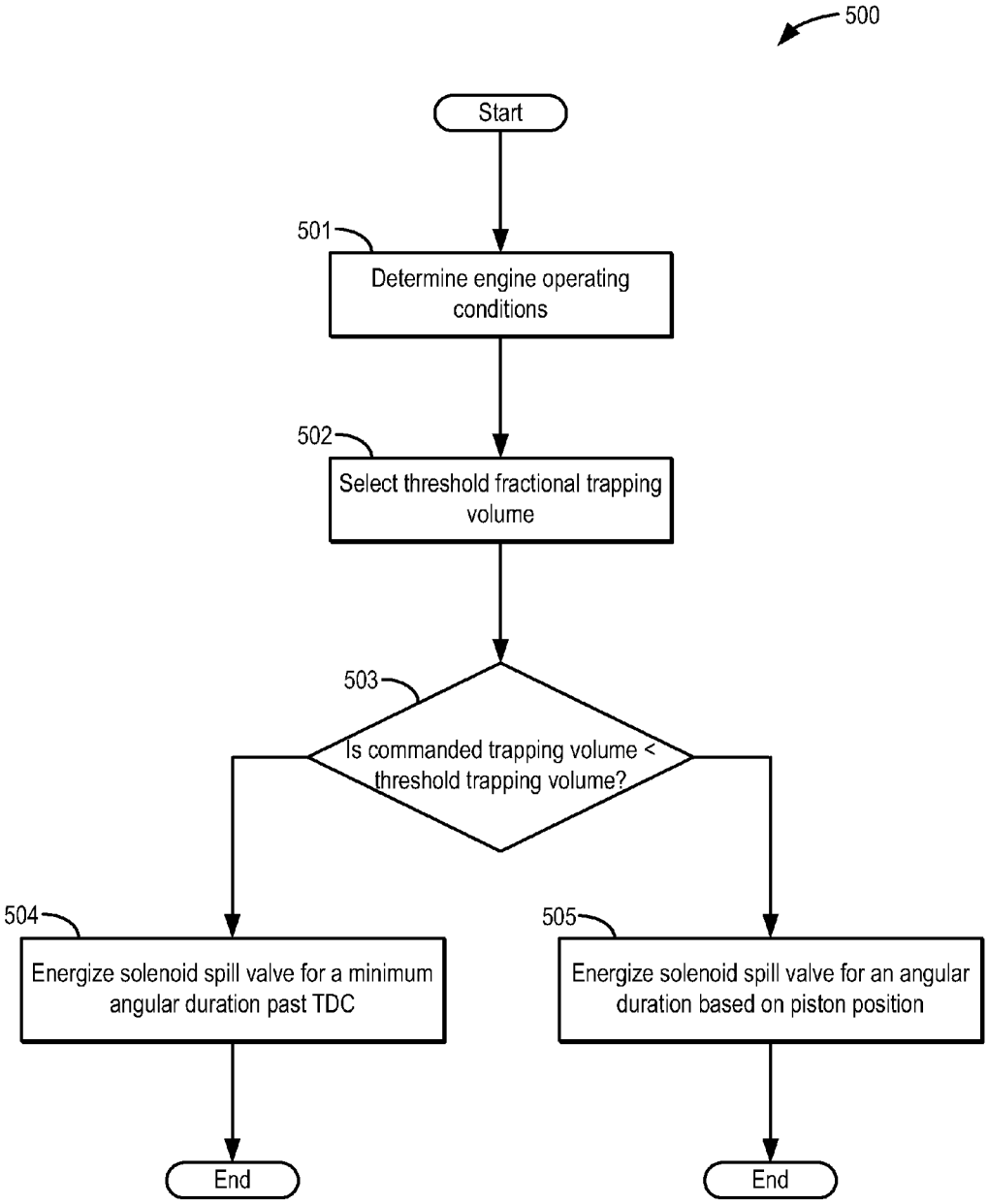
FIG. 5 shows a flow chart for implementing the example minimum energize angle control strategy of FIG. 4.
Figure 6:
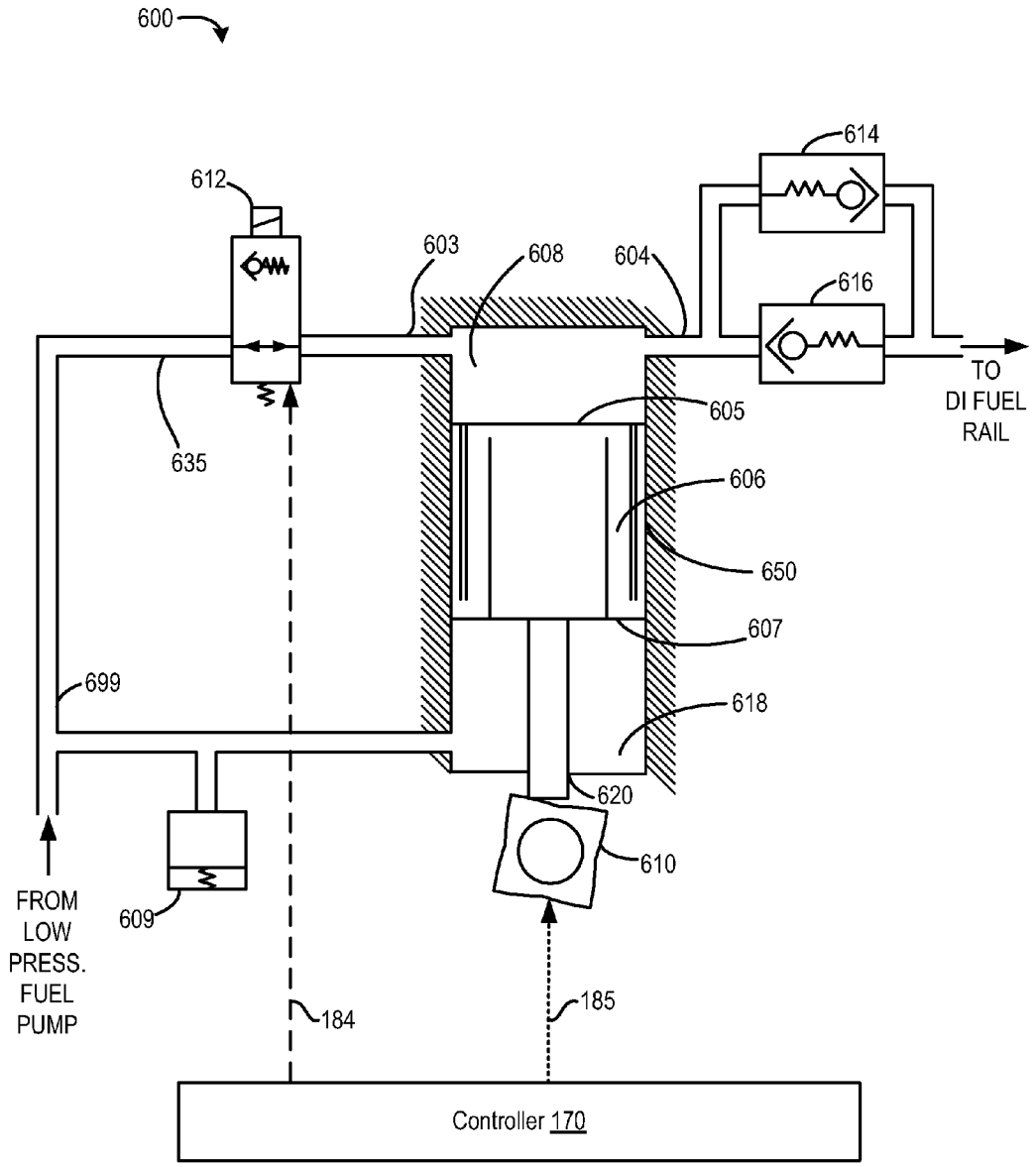
FIG. 6 shows another embodiment of a direct injection fuel pump that can be part of the direct injection fuel system of FIG. 1.

The following detailed description provides information regarding a direct injection fuel pump, its related fuel and engine systems, and several control strategies for regulating fuel volume and pressure to the direct injection fuel rail and injectors sent via the direct injection fuel pump. A schematic diagram of an example fuel system is shown in FIG. 1 while FIG. 2 shows a closer view of a solenoid spill valve coupled to a direct injection fuel pump of FIG. 1. FIG. 3 shows a hold-to-delivery or hold-to-top-dead-center control strategy for operating a direct injection fuel pump. FIG. 4 graphically shows an example minimum energize angle control strategy for operating a direct injection fuel pump while FIG. 5 shows a flow chart corresponding to the control strategy of FIG. 4. Finally, another embodiment of a direct injection fuel pump is shown in FIG. 6.

Regarding terminology used throughout this detailed description, a higher-pressure fuel pump, or direct injection fuel pump, that provides pressurized fuel to direct injectors may be abbreviated as a DI or HP pump. Similarly, a lower-pressure pump (providing fuel pressure generally lower than that of the DI pump), or lift pump, that provides pressurized fuel from a fuel tank to the DI pump may be abbreviated as an LP pump. Zero flow lubrication (ZFL) may refer to direct injection pump operation schemes that involve pumping substantially no fuel into a direct injection fuel rail while maintaining fuel rail pressure near a constant value or incrementally increasing fuel rail pressure. A solenoid spill valve, which may be electronically energized to close and de-energized to open (or vice versa), may also be referred to as a fuel volume regulator, magnetic solenoid valve, and a digital inlet valve, among other names. Depending on when the spill valve is energized during operation of the DI pump, an amount of fuel may be trapped and compressed by the DI pump during a delivery stroke, wherein the amount of fuel may be referred to as fractional trapping volume if expressed as a fraction or decimal, fuel volume displacement, or pumped fuel mass, among other terms.

FIG. 1 shows a direct injection fuel system 150 coupled to an internal combustion engine 110, which may be configured as a propulsion system for a vehicle. The internal combustion engine 110 may comprise multiple combustion chambers or cylinders 112. Fuel can be provided directly to the cylinders 112 via in-cylinder direct injectors 120. As indicated schematically in FIG. 1, the engine 110 can receive intake air and exhaust products of the combusted fuel. The engine 110 may include a suitable type of engine including a gasoline or diesel engine.

Fuel can be provided to the engine 110 via the injectors 120 by way of a fuel system indicated generally at 150. In this particular example, the fuel system 150 includes a fuel storage tank 152 for storing the fuel on-board the vehicle, a low-pressure fuel pump 130 (e.g., a fuel lift pump), a high-pressure fuel pump or direct injection (DI) pump 140, a fuel rail 158, and various fuel passages 154 and 156. In the example shown in FIG. 1, the fuel passage 154 carries fuel from the low-pressure pump 130 to the DI pump 140, and the fuel passage 156 carries fuel from the DI pump 140 to the fuel rail 158. As such, passage 154 may be a low-pressure passage while passage 156 may be a high-pressure passage.

Fuel rail 158 may distribute fuel to each of a plurality of fuel injectors 120. Each of the plurality of fuel injectors 120 may be positioned in a corresponding cylinder 112 of engine 110 such that during operation of fuel injectors 120 fuel is injected directly into each corresponding cylinder 112. Alternatively (or in addition), engine 110 may include fuel injectors positioned at the intake port of each cylinder such that during operation of the fuel injectors fuel is injected in to the intake port of each cylinder. In the illustrated embodiment, engine 110 includes four cylinders. However, it will be appreciated that the engine may include a different number of cylinders.

The low-pressure fuel pump 130 can be operated by a controller 170 to provide fuel to DI pump 140 via fuel passage 154. The low-pressure fuel pump 130 can be configured as what may be referred to as a fuel lift pump. As one example, low-pressure fuel pump 130 can include an electric pump motor, whereby the pressure increase across the pump and/or the volumetric flow rate through the pump may be controlled by varying the electrical power provided to the pump motor, thereby increasing or decreasing the motor speed. For example, as the controller 170 reduces the electrical power that is provided to pump 130, the volumetric flow rate and/or pressure increase across the pump may be reduced. The volumetric flow rate and/or pressure increase across the pump may be increased by increasing the electrical power that is provided to the pump 130. As one example, the electrical power supplied to the low-pressure pump motor can be obtained from an alternator or other energy storage device on-board the vehicle (not shown), whereby the control system can control the electrical load that is used to power the low-pressure pump. Thus, by varying the voltage and/or current provided to the low-pressure fuel pump, as indicated at 182, the flow rate and pressure of the fuel provided to DI pump 140 and ultimately to the fuel rail may be adjusted by the controller 170.

Low-pressure fuel pump 130 may be fluidly coupled to check valve 104 to facilitate fuel delivery and maintain fuel line pressure. In particular, check valve 104 includes a ball and spring mechanism that seats and seals at a specified pressure differential to deliver fuel downstream. In some embodiments, fuel system 150 may include a series of check valves fluidly coupled to low-pressure fuel pump 130 to further impede fuel from leaking back upstream of the valves. Check valve 104 is fluidly coupled to filter 106. Filter 106 may remove small impurities that may be contained in the fuel that could potentially damage engine components. Fuel may be delivered from filter 106 to high-pressure fuel pump (e.g., DI pump) 140. DI pump 140 may increase the pressure of fuel received from the fuel filter from a first pressure level generated by low-pressure fuel pump 130 to a second pressure level higher than the first level. DI pump 140 may deliver high pressure fuel to fuel rail 158 via fuel line 156. DI pump 140 will be discussed in further detail below with reference to FIG. 2. Operation of DI pump 140 may be adjusted based on operating conditions of the vehicle in order to provide more efficient fuel system and engine operation. As such, methods for operating the higher-pressure DI pump 140 will be discussed in further detail below with reference to FIGS. 3-5.

The DI pump 140 can be controlled by the controller 170 to provide fuel to the fuel rail 158 via the fuel passage 156. As one non-limiting example, DI pump 140 may utilize a flow control valve, a solenoid actuated "spill valve" (SV) or fuel volume regulator (FVR), indicated at 202 to enable the control system to vary the effective pump volume of each pump stroke. SV 202 may be separate or part of (i.e., integrally formed with) DI pump 140. The DI pump 140 may be mechanically driven by the engine 110 in contrast to the motor driven low-pressure fuel pump or fuel lift pump 130. A pump piston 144 of the DI pump 140 can receive a mechanical input from the engine crank shaft or cam shaft via a cam 146. In this manner, DI pump 140 can be operated according to the principle of a cam-driven single-cylinder pump. Furthermore, the angular position of cam 146 may be estimated (i.e., determined) by a sensor located near cam 146 communicating with controller 170 via connection 185. In particular, the sensor may measure an angle of cam 146 measured in degrees ranging from 0 to 360 degrees according to the circular motion of cam 146.

As depicted in FIG. 1, a fuel sensor 148 is disposed downstream of the fuel lift pump 130. The fuel sensor 148 may measure fuel composition and may operate based on fuel capacitance, or the number of moles of a dielectric fluid within its sensing volume. For example, an amount of ethanol (e.g., liquid ethanol) in the fuel may be determined (e.g., when a fuel alcohol blend is utilized) based on the capacitance of the fuel. The fuel sensor 148 may be connected to controller 170 via connection 149 and used to determine a level of vaporization of the fuel, as fuel vapor has a smaller number of moles within the sensing volume than liquid fuel. As such, fuel vaporization may be indicated when the fuel capacitance drops off. In some operating schemes, the fuel sensor 148 may be utilized to determine the level of fuel vaporization of the fuel such that the controller 170 may adjust the lift pump pressure in order to reduce fuel vaporization within the fuel lift pump 130.

Further, in some examples, the DI pump 140 may be operated as the fuel sensor 148 to determine the level of fuel vaporization. For example, a piston-cylinder assembly of the DI pump 140 forms a fluid-filled capacitor. As such, the piston-cylinder assembly allows the DI pump 140 to be the capacitive element in the fuel composition sensor. In some examples, the piston-cylinder assembly of the direct fuel injection pump 140 may be the hottest point in the system, such that fuel vapor forms there first. In such an example, the DI pump 140 may be utilized as the sensor for detecting fuel vaporization, as fuel vaporization may occur at the piston-cylinder assembly before it occurs anywhere else in the system.

As shown in FIG. 1, the fuel rail 158 includes a fuel rail pressure sensor 162 for providing an indication of fuel rail pressure to the controller 170. An engine speed sensor 164 can be used to provide an indication of engine speed to the controller 170. The indication of engine speed can be used to identify the speed of DI pump 140, since the pump 140 is mechanically driven by the engine 110, for example, via the crankshaft or camshaft. An exhaust gas sensor 166 can be used to provide an indication of exhaust gas composition to the controller 170. As one example, the gas sensor 166 may include a universal exhaust gas sensor (UEGO). The exhaust gas sensor 166 can be used as feedback by the controller to adjust the amount of fuel that is delivered to the engine via the injectors 120. In this way, the controller 170 can control the air/fuel ratio delivered to the engine to a prescribed set-point.

Furthermore, controller 170 may receive other engine/exhaust parameter signals from other engine sensors such as engine coolant temperature, engine speed, throttle position, absolute manifold pressure, emission control device temperature, etc. Further still, controller 170 may provide feedback control based on signals received from fuel sensor 148, pressure sensor 162, and engine speed sensor 164, among others. For example, controller 170 may send signals to adjust a current level, current ramp rate, pulse width of a solenoid valve (SV) 202 of DI pump 140, and the like via connection 184 to adjust operation of DI pump 140. Also, controller 170 may send signals to adjust a fuel pressure set-point of the fuel pressure regulator and/or a fuel injection amount and/or timing based on signals from fuel sensor 148, pressure sensor 162, engine speed sensor 164, and the like.

The controller 170 can individually actuate each of the injectors 120 via a fuel injection driver 122. The controller 170, the driver 122, and other suitable engine system controllers can comprise a control system. While the driver 122 is shown external to the controller 170, in other examples, the controller 170 can include the driver 122 or can be configured to provide the functionality of the driver 122. The controller 170, in this particular example, includes an electronic control unit comprising one or more of an input/output device 172, a central processing unit (CPU) 174, read-only memory (ROM) 176, random-accessible memory (RAM) 177, and keep-alive memory (KAM) 178. The storage medium ROM 176 can be programmed with computer readable data representing non-transitory instructions executable by the processor 174 for performing the methods described below as well as other variants that are anticipated but not specifically listed.

As shown, direct injection fuel system 150 is a returnless fuel system, and may be a mechanical returnless fuel system (MRFS) or an electronic returnless fuel system (ERFS). In the case of an MRFS, the fuel rail pressure may be controlled via a pressure regulator (not shown) positioned at the fuel tank 152. In an ERFS, a pressure sensor 162 may be mounted at the fuel rail 158 to measure the fuel rail pressure relative to the manifold pressure. The signal from the pressure sensor 162 may be fed back to the controller 170, which controls the driver 122, the driver 122 modulating the voltage to the DI pump 140 for supplying the correct pressure and fuel flow rate to the injectors.

Although not shown in FIG. 1, in other examples, direct injection fuel system 150 may include a return line whereby excess fuel from the engine is returned via a fuel pressure regulator to the fuel tank via a return line. A fuel pressure regulator may be coupled in line with a return line to regulate fuel delivered to fuel rail 158 at a set-point pressure. To regulate the fuel pressure at the set-point, the fuel pressure regulator may return excess fuel to fuel tank 152 via the return line. It will be appreciated that operation of fuel pressure regulator may be adjusted to change the fuel pressure set-point to accommodate operating conditions.

FIG. 2 shows an example of a DI pump 140. DI pump 140 delivers fuel to the engine via intake and delivery pump strokes of fuel supplied to fuel rail 158. The DI fuel pump 140 includes an outlet fluidically coupled to direct injection fuel rail 158. As seen, the pump includes piston 144 constrained to move linearly to intake, compress, and eject fuel. Furthermore, solenoid spill valve 202 is fluidically coupled to an inlet of the direct injection fuel pump. Controller 170 may include computer readable instructions stored in non-transitory memory for executing various control schemes.

When the SV 202 is not energized, the inlet valve 208 is held open and no pumping can occur. When energized, the SV 202 takes a position such that inlet valve 208 functions as a check valve. Depending on the timing of this event, a given amount of pump displacement is used to push a given fuel volume into the fuel rail, thus it functions as a fuel volume regulator. As such, the angular timing of the solenoid retraction may control the effective pump displacement. Furthermore, the solenoid current application may influence the pump noise. Solenoid valve 202, also illustrated in FIG. 1, includes solenoids 206 that may be electrically energized by controller 170 to draw inlet valve 204 away from the solenoids in the direction of check valve 208 to close SV 202. In particular, controller 170 may send a pump signal that may be modulated to adjust the operating state (e.g., open or check valve) of SV 202. Modulation of the pump signal may include adjusting a current level, current ramp rate, a pulse-width, a duty cycle, or another modulation parameter. Further, inlet valve 204 may be biased such that, upon solenoids 206 becoming de-energized, inlet valve 204 may move in the direction of the solenoids until contacting inlet valve plate 210 to be placed in an open state in which fuel may flow into pressure chamber 212 of DI pump 140. Operation of piston 144 of DI pump 140 may increase the pressure of fuel in pressure chamber 212. Upon reaching a pressure set-point, fuel may flow through outlet valve 216 to fuel rail 158.

As presented above, direct injection or high-pressure fuel pumps may be piston pumps that are controlled to compress a fraction of their full displacement by varying closing timing of the solenoid spill valve. As such, a full range of pumping volume fractions may be provided to the direct injection fuel rail and direct injectors depending on when the spill valve is energized and de-energized. It has been observed that for pumping relatively small displacements, that is, when the spill valve is energized to stop fuel flow out of the pressure chamber of the DI pump and toward the pump inlet shortly before top-dead-center (TDC) of the pump piston, fuel metering becomes subject to variation. This variation may stem from having several degrees of uncertainty in pump piston position (e.g. ±10° of crankshaft angle). Top-dead-center may refer to when the pump piston reaches a maximum height into the pump compression chamber. This variation may adversely affect control strategies for operating the DI pump as well as lead to inefficient pump and fuel system operation since the control may depend on accurate fuel metering. As such, numerous control strategies exist for the DI pump that attempt to operate the DI pump outside the range of small pump displacements or small trapping volumes.

FIG. 3 shows an example operating sequence 300 of DI pump 140, which may also be referred to as a hold-to-TDC control strategy. Generally, hold-to-TDC control strategies are applied to smaller trapping volumes, such as those ranging from 0 to 0.15 (0% to 15%). In particular, sequence 300 shows the operation of DI pump 140 during intake and delivery strokes of fuel supplied to fuel rail 158. Each of the illustrated moments (e.g., 310, 320, 330, and 340) of sequence 300 show events or changes in the operating state of DI pump 140. Signal timing chart 302 shows a pump position 350, a SV applied voltage signal 360 for controlling fuel intake into the DI pump 140, and a SV current 370 resulting from the applied voltage signal 360.

At 310, beginning at time A, the DI pump may begin an intake stroke as piston 144 positioned at top-dead-center (TDC) is pushed outwards from pressure chamber 212 and SV applied voltage (or pull-in applied voltage) 360 is at 0% duty cycle (GND) while inlet valve 204 is open, allowing fuel to enter the pressure chamber 212. Next, during 320 beginning at time B piston 144 reaches bottom-dead-center (BDC) and is retracted into pressure chamber 212. The top-dead-center position of the piston 144 includes when the piston 144 is at a top position to consume all of a displacement volume of compression chamber 212 of the DI fuel pump 140. Similarly, the bottom-dead-center position of piston 144 includes when the piston 144 is at a bottom position to maximize the displacement volume of compression chamber 212.

In preparation for fuel delivery, a pull-in impulse 362 of the SV applied voltage 360 is initiated to close inlet valve 204. In response to the pull-in impulse 362, the solenoid current 370 begins to increase, closing inlet valve 204. During the pull-in impulse 362, the SV applied voltage 360 signal may be 100% duty cycle, however, the SV applied voltage 360 signal may also be less than 100% duty cycle. Furthermore, the duration of the pull-in impulse 362, the duty cycle impulse level, and the duty cycle impulse profile (e.g., square profile, ramp profile, and the like) may be adjusted corresponding to the SV, fuel system, engine operating conditions, and the like, in order to reduce pull-in current and duration, thereby reducing noise, vibration, and harshness (NVH) during fuel injection. By controlling the pull-in current level, pull-in current duration or the pull-in current profile, the interaction between the solenoid armature and the DI pump's inlet valve 204 may be controlled. Also shown during 320, some fuel in pressure chamber 212 may be pushed out through inlet valve 204 before inlet valve 204 fully closes while the piston 144 is retracted from BDC.

At time C (moment 330), inlet valve 204 fully closes in response to the SV applied voltage pull-in impulse and the increasing solenoid current 370. Furthermore, outlet valve 216 is opened, allowing for fuel injection from the pressure chamber 212 into fuel rail 158. After time C during 340, the SV pull-in applied voltage 360 may be set to a holding signal 364 of approximately 25% duty cycle to command a holding solenoid current 370 in order to maintain the inlet valve 204 in the closed position during fuel delivery. At the end of the holding current duty cycle, which is coincident with time A1, SV applied voltage is reduced to ground (GND), lowering the solenoid current 370, and opening inlet valve 204 (while closing outlet valve 216) to begin another fuel intake phase. Furthermore, the duty cycle level and signal duration of holding signal 364 may be adjusted in order to initiate specific outcomes, such as reducing solenoid current and NVH.

Upon completion of 340 when holding signal 364 ends so the SV applied voltage is reduced to ground (GND), opening inlet valve 204 may occur coincident with the top-dead-center position of piston 144 as shown at 310. Therefore, the spill valve 202 is held in the closed position until TDC is reached, known as a hold-to-TDC control strategy. Additionally, as seen in FIG. 3, time C (moment 330) may occur anywhere between time B, when piston 144 reaches the BDC position, and time A1, when piston 144 reaches the TDC position again to complete a cycle of the pump and to start the next cycle (consisting of intake and delivery strokes). Particularly, inlet valve 204 may fully close at any moment between the BDC and TDC positions, thereby controlling the amount of fuel that is pumped by the DI pump 140. As previously mentioned, the amount of fuel may be referred to as fractional trapping volume or fractional pumped displacement, which may be expressed as a decimal or percentage. For example, the trapping volume fraction is 100% when the solenoid spill valve is energized to a closed position coincident with the beginning of a compression stroke of the piston of the direct injection fuel pump.

It is noted that for larger trapping volumes, the pressure present in chamber 212 during the delivery stroke (when piston 144 travels from BDC to TDC) may hold the SV 202 closed to TDC by default without energizing SV 202. However, for smaller trapping volumes, it may be desirable to use solenoid current to hold SV 202 to TDC, as shown in FIG. 3. The reason for this is that there may not be a high enough pressure present in chamber 212 to hold SV 202 closed when relatively smaller trapping volumes are commanded. As such, due to the uncertainty in solenoid actuation, it is desirable to hold SV 202 closed with electrical force to TDC to avoid a release prior to TDC of the piston 144.

Furthermore, energizing and de-energizing spill valve 202 may be controlled by controller 170 based on the angular position of cam 146 received via connection 185. In other words, SV 202 may be controlled (i.e., activated and deactivated) in synchronization with the angular position of cam 146. The angular position of cam 146 may correspond to the linear position of piston 144, that is, when piston 144 is at TDC or BDC or any other position in between. In this way, the applied voltage (i.e., energizing) to SV 202 to open and close valve 204 may occur between BDC and TDC of piston 144. Also, according to the present hold-to-TDC strategy, valve 204 may be held open until the TDC position is again reached at time A1. For example, if SV 202 is energized 60% through the delivery stroke of piston 144 (between B and A1), then 60% of the fuel in chamber 212 may be ejected through SV 202 while the remaining 40% of fuel is compressed and sent through check valve 216 and into the direct injection fuel rail. Upon piston 144 ending the delivery stroke at the TDC position, then SV 202 is deactivated according to the hold-to-TDC control strategy 300.

Control strategies that operate the DI pump outside small displacements may not be compatible when low displacements are desired. For example, a zero flow lubrication strategy may be commanded when direct fuel injection is not desired (i.e., requested by the controller 170). When direct injection ceases, pressure in the fuel rail is desired to remain at a near-constant level. As such, the spill valve may be deactivated to the open position to allow fuel to freely enter and exit the pump pressure chamber so fuel is not pumped into the fuel rail. An always-deactivated spill valve corresponds to a 0% trapping volume, that is, 0 trapped volume or 0 displacement. As such, lubrication and cooling of the DI pump may be reduced while no fuel is being compressed, thereby leading to pump degradation. Therefore, according to ZFL methods, it may be beneficial to energize the spill valve to pump a small amount of fuel when direct injection is not requested. As such, operation of the DI pump may be adjusted to maintain a pressure at the outlet of the DI pump at or below the fuel rail pressure of the direct injection fuel rail, thereby forcing fuel past the piston-bore interface of the DI pump. By maintaining the outlet pressure of the DI pump just below the fuel rail pressure, without allowing fuel to flow out of the outlet of the DI pump into the fuel rail, the DI pump may be kept lubricated, thereby reducing pump degradation. This general operation may be referred to as zero flow lubrication (ZFL).

The implementation of ZFL control schemes may appear as minimum DI pump commands, that is, only commanding trapping volumes above a certain threshold, such as 0.1 or 10%. The minimum DI pump command may vary with fuel rail pressure and be learned during engine and pump operation to compensate for error in piston position sensing or other factors. As such, for ZFL control schemes, the solenoid valve 202 may always be energized prior to the TDC position of piston 144. Furthermore, from pump commands between 0 and the ZFL command for the particular fuel rail pressure, no fuel may be sent to the fuel rail 158 (0 volume flow). Commanding the ZFL trapping volume may maximize the pressure in the chamber 212 while sending no fuel to fuel rail 158 when direct injection is not requested. This may increase lubrication in the piston-bore interface of the DI pump 140.

Therefore, for operating schemes such as zero flow lubrication and others that utilize small fuel displacements, the inventors herein have recognized that a control strategy is needed that reliably and accurately controls the spill valve for small fraction trapping volumes. In the context of this disclosure, as previously mentioned small fractional trapping volumes may range from about 0 to 0.15 (0% to 15%). According to DI pump control strategies such as strategy 300 of FIG. 3, commanding small fractional trapping volumes involves activating SV 202 near the TDC position of piston 144. Visually, referring to FIG. 3, commanding small trapping volumes shifts time C and moment 330 closer to time A1. Depending on the rotational speed of cam 146 and therefore the linear speed of piston 144, energizing and de-energizing SV 202 to close and open valve 204 may occur in a small period of time. The inventors herein have recognized that commanding small fractional trapping volumes according to hold-to-TDC control strategy 300 may lead to unreliable SV 202 actuation. Unreliable and unrepeatable solenoid valve behavior may lead to inefficient DI pump performance.

The inventors herein have proposed that instead of commanding deactivation of SV 202 based on the TDC position according to control strategy 300 during small trapping volumes, SV 202 may be commanded to remain energized or "on" for a minimum angle. In other words, when the desired trapping volume is below a threshold, the solenoid spill valve is energized for a minimum angular duration independent of the TDC position. As such, the minimum angular duration may extend beyond the TDC position, thereby energizing SV 202 past TDC, contrary to hold-to-TDC control strategies. Conversely, when the desired trapping volume of the DI pump is above the threshold, then the spill valve is energized for only an angular duration based on the TDC position or other control scheme. The angular duration refers to the time for cam 146 to rotate to a position that corresponds to a number of degrees, such as 15 or 25 degrees. In this way, DI pump 140 can be controlled according to hold-to-TDC control strategy 300 when the trapping volume is above the threshold and controlled according to the proposed minimum angle strategy below the threshold.

FIG. 4 shows an example timing chart 400 for a minimum energize angle control strategy for operating the DI pump according to an embodiment of the present disclosure. The horizontal axis for chart 400 is time while the vertical axes vary according to the quantity. Timing chart 400 shows graphs for a pump position 410, a solenoid valve position 420, and a cam angular position. Similar to FIG. 3, pump position 410 may vary from the top-dead-center and bottom-dead-center positions of piston 144. For the sake of simplicity, instead of showing solenoid valve applied voltage and current, the solenoid valve position 420 is shown in FIG. 4 which may either be open or closed. The open position occurs when no voltage is applied to SV 202 (de-energized or deactivated) while the closed position occurs when voltage is applied to SV 202 (energized or activated). While in reality the transitions from the open and closed positions occur over a finite time, that is, the time to switch between the open and closed positions of valve 204, the transitions are shown as occurring instantaneously in FIG. 4. Lastly, the cam angular position 430 varies from 0 degrees to 180 degrees, wherein 0 degrees corresponds to BDC and 180 corresponds to TDC. Since cam 146 continuously rotates, its position as measured by a sensor may oscillate between 0 and 180 degrees, where the cam 146 completes a full cycle every 360 degrees. Again, the minimum angular duration may refer to the number of degrees of rotation of cam 146 (and the connected engine camshaft) upon which the activation of SV 202 is based.

It is noted that in some examples, the full cycle of cam 146 may correspond to the full DI pump cycle consisting of the intake and delivery strokes, as shown in FIG. 4. Other ratios of cam cycles to DI pump cycles may be possible while remaining within the scope of the present disclosure. Furthermore, while the graphs of pump position 410 and cam angular position 430 are shown as straight lines, the graphs may exhibit more oscillatory behavior. For the sake of simplicity, straight lines are used in FIG. 4 while it is understood that other graph profiles are possible. Lastly, it is assumed that the engine and cam 146 are rotating at substantially constant speeds throughout the time shown since the slope of cam angular position 430 appears to remain substantially the same in FIG. 4.

Beginning at time t1, piston 144 may be at the BDC position according to a 0 degree position of cam 146. At this time, the solenoid valve 202 is open (deactivated) to allow fuel to flow into and out of chamber 212. After time t1, the DI pump delivery stroke may commence, wherein between times t1 and t2 fuel is pushed by piston 144 backwards through valve 202 into low-pressure fuel line 154 towards the lift pump 130. The time elapse between times t1 and t2 may correspond to fuel leaving chamber 212 according to commanded (desired) trapping volume. At t2, solenoid spill valve 202 may be energized into the closed position, wherein fuel is substantially prevented from passing through valve 204. Between the closing of valve 204 and TDC position 433, the remaining fuel in chamber 212 is pressurized and sent through outlet check valve 216. According to the commanded small fractional trapping volume, the amount of fuel pressurized between time t2 and TDC position 433 may be below the threshold of 15% (0.15) in some examples.

When TDC position 433 is attained, instead of ceasing input voltage to SV 202 as what occurs in hold-to-TDC control strategy 300, the SV 202 remains energized past TDC position 433. The SV 202 is then deactivated at time t3 after a time duration T1 has elapsed corresponding to an angular duration of cam 146. In some examples the angular duration is 10 camshaft degrees. After the time (angular) duration T1 has passed and at time t3 SV 202 is deactivated (applied voltage and resulting current cease), the piston 144 continues traveling to the BDC position as driven by cam 146 until the BDC position is reached at time t4. Another delivery stroke of DI pump 140 may commence at time t4 followed by a subsequent intake stroke, wherein SV 202 is again held closed longer than when piston 144 reaches TDC position 434. In particular, SV 202 is applied with voltage between times t4 and t5 for duration T2. As long as the commanded trapping volume is below the threshold, such as 15%, then DI pump cycles may continue repeating according to the timing chart 400 for the minimum time control strategy.

It is noted that time/angular durations T1 and T2 may be the same (10 camshaft degrees) in FIG. 4, but in other examples may be different to satisfy changing conditions of the fuel system, such as the cam and pump speeds. Furthermore, as previously mentioned, the DI pump cycle may consist of one intake stroke and one delivery stroke. Referring to FIG. 4, a delivery stroke occurs between time t1 and TDC position 433 while another delivery stroke occurs between time t4 and TDC position 434. An intake stroke occurs between TDC position 433 and time t4. Also, in some examples, SV 202 may be deactivated after time duration T1 or T2 has elapsed. For example, SV 202 may be deactivated after 15 camshaft degrees instead of 10 camshaft degrees. In other words, time t3 may occur later than the interval shown by duration T1 while time t6 may occur later than the interval shown by duration T2. The time duration may be longer while not adversely affecting the intake of fuel during the following intake stroke of the pump. In other words, deactivation of the solenoid spill valve 202 after the TDC position is reached may not affect the fuel trapping volume fraction. In another example, the minimum angular duration may be 25 degrees. In this example, 15 degrees of activation of SV 202 may occur prior to the TDC position of the pump piston while the remaining 10 degrees occur after the TDC position of the pump piston. It can be seen that other angular durations and the corresponding on time of the SV 202 may be possible while remaining within the scope of the present disclosure.

In summary, the present minimum energize angle control strategy may always keep the solenoid valve 202 energized for at least an angular duration. For smaller trapping volumes, this includes energizing the SV 202 past the TDC position of the pump piston. For example, energizing SV 202 for at least 25 degrees as the minimum angular duration may extend the activation time of the solenoid valve past TDC position for smaller trapping volumes. It is understood that if larger pump commands were issued, such as greater than 15%, then the angular duration may allow SV 202 to be de-energized prior to the TDC position. Other similar scenarios are possible.

FIG. 5 shows a general operation method 500 for implementing the minimum energize angle control strategy as explained with regard to FIG. 4. In this context, the minimum angle control strategy refers to energizing the solenoid spill valve for an angular duration independent of the position of pump piston 144, in particular the TDC position. Referring to FIG. 5, at 501, a number of engine operating conditions may be determined. The operating conditions include, for example, engine speed, minimum angular duration, commanded fractional trapping volume as explained below, fuel composition and temperature, engine fuel demand, driver demanded torque, and engine temperature. The operating conditions may be useful for operating the fuel system and ensuring efficient operation of the lift and DI pumps. Upon determining the operating conditions, at 502 the method includes selecting a threshold fractional trapping volume of fuel or other fluid pumped through the fuel system. In one example the threshold may be automatically determined by controller 170 in real-time with changing conditions of the engine. As previously stated, the threshold trapping volume fraction may be selected based on when repeatable and reliable behavior of the solenoid spill valve starts to degrade.

Next, at 503, the method includes determining if the commanded trapping volume fraction is less than the threshold trapping volume fraction. The commanded trapping volume may be a desired trapping volume determined by controller 170, which receives a number of variables to calculate the commanded trapping volume. For example, during the aforementioned zero flow lubrication scheme when direct injection is not requested but pump lubrication is desired, a 5% trapping volume may be commanded by the controller 170, wherein the command is implemented by applying voltage to SV 202. If the commanded trapping volume is less than the threshold trapping volume, then at 504 the controller 170 sends the voltage to energize solenoid spill valve 202 for the minimum angular duration, which in many cases may energize SV 202 past the TDC position. In another example, the SV 202 can be energized for longer than the minimum angular duration. The minimum angular duration is independent of the linear position of pump piston 144 of the DI fuel pump 140. In some examples, the minimum angular duration may be 10 camshaft degrees while the trapping volume fraction threshold is 15% (0.15).

Alternatively, if the commanded trapping volume is greater than the threshold trapping volume, then at 505 the controller 170 sends the voltage to energize solenoid spill valve 202 for an angular duration based on position of the DI pump piston 144. As stated before, in one example the angular duration at 505 is the time for cam 146 to reach the position that corresponds to the TDC position of piston 144. As such, at 505, the SV 202 is deactivated (de-energized) coincident with the TDC position of piston 144 similar to how the SV 202 is deactivated during hold-to-TDC control strategies. In summary, deactivation of SV 202 is set past TDC for small trapping volumes. Step 505 is executed when a first condition is met, which is when the trapping volume fraction is above the threshold. Similarly, step 504 is executed when a second condition is met, which is when the trapping volume is below the threshold. It is noted that the controller may detect the angular position of the driving cam 146 in order to synchronize energizing the solenoid spill valve with the driving cam 146 and pump piston 144 during the first and second conditions.

In this way, by deactivating SV 202 after TDC of the DI pump for small trapping volumes, the deactivating or turn-off timing of SV 202 may not influence the trapped volume or fuel compressed by the DI pump. Furthermore, with this control strategy, the activation and deactivation of the solenoid spill valve 202 may be repeatable and reliable between cycles of the DI pump. Also, reliable SV 202 energizing may lead to DI pump behavior that is more accurately controlled with low trapping volumes. Lastly, the minimum angular duration strategy (hold-past-TDC strategy) may provide a more robust way to operate the DI pump when there is uncertainty in the position of piston 144. According to this strategy, by de-energizing SV 202 past TDC even with piston position error, de-energizing SV 202 prior to TDC may be avoided.

FIG. 6 shows another embodiment of a direct injection fuel pump, simplified to show the physical relationships between various components. DI pump 600 of FIG. 6 may be similar to DI pump 140 shown in FIGS. 1 and 2. Furthermore, DI pump 600 may be used with the direct injection fuel system 150 and engine 110 of FIG. 1, replacing DI pump 140 of FIG. 1. Controller 170 of FIG. 1 is included in FIG. 6 for operating a solenoid spill valve 612.

Inlet 603 of direct injection fuel pump compression chamber 608 is supplied fuel via low-pressure fuel pump 130 as shown in FIG. 1. The fuel may be pressurized upon its passage through direct injection fuel pump 600 and supplied to fuel rail 158 through pump outlet 604. In the depicted example, direct injection pump 600 may be a mechanically-driven displacement pump that includes a pump piston 606, a piston rod 620, a pump compression chamber 608, and a step-room 618. A passage that connects step-room 618 to a pump inlet 699 may include an accumulator 609, wherein the passage allows fuel from the step-room 618 to re-enter the low-pressure line surrounding inlet 699. The step-room 618 and compression chamber 608 may include cavities positioned on opposing sides of the pump piston. A top side 605 of piston 606 may partially define compression chamber 608 while an opposite, bottom side 607 of piston 606 may partially define the step-room 618. In one example, engine controller 170 may be configured to drive the piston 606 in direct injection pump 600 by driving cam 610. Cam 610 includes four lobes and completes one rotation for every two engine crankshaft rotations, in one example.

A solenoid spill valve 612 may be coupled to pump inlet 603. Controller 170 may be configured to regulate fuel flow through spill valve 612 by energizing or de-energizing the solenoid (based on the solenoid valve configuration) in synchronism with the driving cam. Solenoid spill valve 612 may be similar to solenoid valve 202 of FIGS. 1-3. Accordingly, solenoid spill valve 612 may be operated in two modes. In a first mode, solenoid spill valve 612 is positioned within inlet 603 to limit (e.g., inhibit) the amount of fuel traveling upstream of the solenoid spill valve 612. In comparison, in the second mode, solenoid spill valve 612 is effectively disabled and fuel can travel upstream and downstream of inlet check valve.

As such, solenoid spill valve 612 may be configured to regulate the mass (or volume) of fuel compressed into the direct injection fuel pump. In one example, controller 170 may adjust a closing timing of the solenoid spill valve 612 to regulate the mass of fuel compressed. For example, a late inlet check valve closing may reduce the amount of fuel mass ingested into the compression chamber 608. The solenoid spill valve opening and closing timings may be coordinated with respect to stroke timings of the direct injection fuel pump.

Pump inlet 699 allows fuel from the low-pressure fuel pump to enter solenoid spill valve 612. Piston 606 reciprocates up and down within compression chamber 608. DI pump 600 is in a compression stroke when piston 606 is traveling in a direction that reduces the volume of compression chamber 608. DI pump 600 is in a suction stroke when piston 606 is traveling in a direction that increases the volume of compression chamber 608. A forward flow outlet check valve 616 may be coupled downstream of an outlet 604 of the compression chamber 608. Outlet check valve 616 opens to allow fuel to flow from the compression chamber outlet 604 into a fuel rail (such as fuel rail 158) only when a pressure at the outlet of direct injection fuel pump 600 (e.g., a compression chamber outlet pressure) is higher than the fuel rail pressure. Another check valve 614 (pressure relief valve) may be placed in parallel with check valve 616. Valve 614 allows fuel flow out of the DI fuel rail 158 toward pump outlet 604 when the fuel rail pressure is greater than a predetermined pressure. Valve 614 may be set at a relatively high relief pressure such that valve 614 acts only as a safety valve that does not affect normal pump and direct injection operation.

During conditions when direct injection fuel pump operation is not requested, controller 170 may activate and deactivate solenoid spill valve 612 to regulate fuel flow and pressure in compression chamber 608 to a single, substantially constant pressure during most of the compression (delivery) stroke. Control of the DI pump in this way may be included in zero flow lubrication methods, as presented above. During such ZFL operation, on the intake stroke the pressure in compression chamber 608 drops to a pressure near the pressure of the lift pump 130. Lubrication of DI pump 600 may occur when the pressure in compression chamber 608 exceeds the pressure in step-room 618. This difference in pressures may also contribute to pump lubrication when controller 170 deactivates solenoid spill valve 612. Deactivation of spill valve 612 may also reduce noise produced by valve 612. One result of this regulation method is that the fuel rail is regulated to a pressure depending on when solenoid spill valve 612 is energized during the delivery stroke. Specifically, the fuel pressure in compression chamber 608 is regulated during the compression (delivery) stroke of direct injection fuel pump 600. Thus, during at least the compression stroke of direct injection fuel pump 600, lubrication is provided to the pump. When the DI pump enters a suction stroke, fuel pressure in the compression chamber may be reduced while still some level of lubrication may be provided as long as the pressure differential remains.

As such, according to ZFL, operation of the DI pump may be adjusted to maintain a pressure at the outlet of the DI pump at or below the fuel rail pressure of the direct injection fuel rail. Since small fractional trapping volumes may be desirable to substantially prevent fuel from flowing past outlet check valve 304 when no direct injection is requested, the minimum energize time control strategies as shown in FIGS. 4 and 5 may be used with ZFL methods to provide reliable operation of solenoid spill valve 612. As such, the outlet pressure of the DI fuel pump may remain just below the fuel rail pressure by energizing spill valve 612 prior to a TDC position of piston 606 and keeping it energized past TDC according to the minimum angular duration. In this way, spill valve operation may be more repeatable and predictable, even when using smaller trapping volumes, to force fuel through the piston-bore interface while substantially preventing fuel from flowing out of outlet 604 into the fuel rail, thereby lubricating the DI pump 600 to reduce premature pump degradation.

It is noted here that DI pump 600 of FIG. 6 is presented as an illustrative example of one possible configuration for a DI pump. Components shown in FIG. 6 may be removed and/or changed while additional components not presently shown may be added to pump 600 while still maintaining the ability to deliver high-pressure fuel to a direct injection fuel rail. Furthermore, the methods presented above may be applied to various configurations of pump 600 along with various configurations of fuel system 150 of FIG. 1. In particular, the zero flow lubrication and minimum angular duration methods described above may be implemented in various configurations of DI pump 600 without adversely affecting normal operation of the pump 600.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

in response to a fuel trapping volume fraction being below a threshold and a direct fuel injection not being requested, energizing a solenoid spill valve of a direct injection fuel pump at a position of a piston of the direct injection fuel pump, the position based on a requested fuel amount;

maintaining the solenoid spill valve energized for or longer than a predetermined angular duration, the predetermined angular duration being independent of the position of the piston of the direct injection fuel pump, where the solenoid spill valve functions as a check valve when energized;

flowing fuel to a compression chamber without allowing fuel to flow into a fuel rail; and de-energizing the solenoid spill valve after a top-dead-center position of the piston is reached; and in response to the fuel trapping volume fraction being above the threshold and a direct fuel injection not being requested, energizing the solenoid spill valve until the top-dead-center position of the piston is reached using a hold-to-top-dead-center control without flowing fuel to the compression chamber and without allowing fuel to flow into the fuel rail.

2. The method of claim 1, wherein the predetermined angular duration is 10 camshaft degrees, and wherein the predetermined angular duration is longer than an angular duration corresponding to the hold-to-top-dead-center control for a given trapping volume fraction.

3. The method of claim 2, wherein the fuel trapping volume fraction threshold is 15%, and wherein de-energizing the solenoid spill valve after the top-dead-center position of the piston opens the solenoid spill valve after the top-dead-center position of the piston, and wherein the hold-to-top-dead-center control includes energizing the solenoid spill valve before the top-dead-center position of the piston, and de-energizing the solenoid spill valve before or at the top-dead-center position of the piston.

4. The method of claim 1, wherein the top-dead-center position of the piston includes when the piston consumes all of a displacement volume of the compression chamber of the direct injection fuel pump the piston is contained in, and wherein energizing the solenoid spill valve with the hold-to-top-dead-center control includes maintaining the solenoid spill valve energized for longer than the predetermined angular duration.

5. The method of claim 4, wherein de-energizing the solenoid spill valve after the top-dead-center position of the piston is reached does not affect the fuel trapping volume fraction, wherein the energizing occurs before the top-dead-center position of the piston, and wherein the maintaining includes maintaining the solenoid spill valve energized during the top-dead-center position of the piston.

6. The method of claim 1, wherein the solenoid spill valve is energized before the top-dead-center position of the piston, and wherein the energizing closes the solenoid spill valve before the top-dead-center position of the piston, wherein an angular duration based on the position of the piston is longer than the predetermined angular duration.

7. A fuel system, comprising:

a direct injection fuel pump including an outlet fluidically coupled to a direct injection fuel rail, and including a piston constrained to move linearly to intake, compress, and eject fuel;

a solenoid spill valve fluidically coupled to an inlet of the direct injection fuel pump, and where the solenoid spill valve functions as a check valve when energized; and a controller with computer readable instructions stored in non-transitory memory for:

when a fuel trapping volume fraction is below a threshold and a direct fuel injection is not requested by the controller, energizing the solenoid spill valve before a top-dead-center position of the piston is reached, maintaining the solenoid spill valve energized for or longer than a predetermined angular duration independent of a position of the piston, and wherein the solenoid spill valve is deactivated after the top-dead-center position of the piston is reached; and when the fuel trapping volume fraction is above the threshold and the direct fuel injection is not requested by the controller, energizing the solenoid spill valve before the top-dead-center position of the piston is reached, maintaining the solenoid spill valve energized for an angular duration based on the position of the piston, and deactivating the solenoid spill valve before or at the top-dead-center position of the piston.

8. The fuel system of claim 7, further comprising a fuel lift pump fluidically coupled to the inlet of the direct injection fuel pump via a low-pressure fuel line, and wherein the deactivating includes de-energizing the solenoid spill valve.

9. The fuel system of claim 8, wherein deactivating the solenoid spill valve opens the solenoid spill valve to an open position allowing fuel to flow between a compression chamber of the direct injection fuel pump and the low-pressure fuel line, and wherein, when the fuel trapping volume fraction is below the threshold, the solenoid spill valve is maintained energized through the top-dead-center position of the piston.

10. The fuel system of claim 7, wherein the fuel trapping volume fraction threshold is 15%, wherein deactivating the solenoid spill valve after the top-dead-center position of the piston opens the solenoid spill valve after the top-dead-center position of the piston, and wherein, when the fuel trapping volume fraction is above the threshold, the solenoid spill valve is deactivated at the top-dead-center position of the piston.

11. The fuel system of claim 7, wherein the position of the piston is measured by a sensor that detects an angular position of a driving cam providing power to the piston, and wherein the sensor is connected to the controller.

12. The fuel system of claim 11, wherein the controller further commands energizing and deactivating the solenoid spill valve, and wherein the predetermined angular duration is longer than an angular duration corresponding to a hold-to-top-dead-center control for a given trapping volume fraction.

13. The fuel system of claim 7, wherein the predetermined angular duration is 10 camshaft degrees, and wherein energizing the solenoid spill valve before the top-dead-center position of the piston closes the solenoid spill valve before the top-dead-center position of the piston.

14. The fuel system of claim 7, wherein energizing the solenoid spill valve includes the solenoid spill valve functioning as a check valve.

15. A fuel system, comprising:

a direct injection fuel pump including an outlet fluidically coupled to a direct injection fuel rail, and including a piston constrained to move linearly to intake, compress, and eject fuel;

a solenoid spill valve fluidically coupled to an inlet of the direct injection fuel pump, and where the solenoid spill valve functions as a check valve when energized; and a controller with computer readable instructions stored in non-transitory memory for:

when a fuel trapping volume fraction is below a threshold and a direct fuel injection is not requested by the controller, energizing the solenoid spill valve at before a top-dead-center position of the piston is reached, maintaining the solenoid spill valve energized for or longer than a predetermined angular duration independent of a position of the piston, wherein the solenoid spill valve is deactivated after the top-dead-center position of the piston is reached and wherein fuel flows to a compression chamber without allowing fuel to flow into the direct injection fuel rail, and where the solenoid spill valve is de-energized after the top-dead-center position of the piston is reached; and when the fuel trapping volume fraction is above the threshold and the direct fuel injection is not requested by the controller, energizing the solenoid spill valve before the top-dead-center position of the piston is reached, maintaining the solenoid spill valve energized for an angular duration based on the position of the piston without flowing fuel to the compression chamber and without allowing fuel to flow into the direct injection fuel rail, and deactivating the solenoid spill valve before or at the top-dead-center position of the piston.

16. The fuel system of claim 15, wherein the controller further detects an angular position of a driving cam that powers the direct injection fuel pump to synchronize energizing the solenoid spill valve when the fuel trapping volume fraction is above or below the threshold and the direct fuel injection is not requested by the controller.

17. The fuel system of claim 15, wherein the fuel trapping volume fraction threshold is 15%, and where energizing the solenoid spill valve closes the solenoid spill valve.

18. The fuel system of claim 15, wherein the fuel trapping volume fraction is 100% when the solenoid spill valve is energized to a closed position coincident with a beginning of a compression stroke of the piston of the direct injection fuel pump.

* * * * *